US008926466B2

(12) United States Patent
Fukuoka et al.

(10) Patent No.: US 8,926,466 B2
(45) Date of Patent: Jan. 6, 2015

(54) VESSEL PROPULSION APPARATUS

(71) Applicant: Yamaha Hatsudoki Kabushiki Kaisha, Iwata-shi, Shizuoka (JP)

(72) Inventors: Yoshihito Fukuoka, Shizuoka (JP); Daisuke Nakamura, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 65 days.

(21) Appl. No.: 13/786,493

(22) Filed: Mar. 6, 2013

(65) Prior Publication Data

US 2014/0031164 A1 Jan. 30, 2014

(30) Foreign Application Priority Data

Jul. 27, 2012 (JP) ..... 2012-167568

(51) Int. Cl.
*F16H 48/08* (2006.01)
*F16H 57/02* (2012.01)

(52) U.S. Cl.
USPC ..... 475/204; 475/201; 123/195 P; 74/606 R

(58) Field of Classification Search
USPC ..... 475/201, 204, 207, 218; 74/606 R; 123/195 P, 197.1; 440/86
See application file for complete search history.

(56) References Cited

U.S. PATENT DOCUMENTS

| | | | | |
|---|---|---|---|---|
| 3,019,671 | A * | 2/1962 | Albinson et al. | 475/145 |
| 3,362,375 | A * | 1/1968 | Shimanckas | 440/75 |
| 4,009,677 | A * | 3/1977 | Croisant | 440/6 |
| 4,413,865 | A | 11/1983 | Hackbarth | |
| 5,197,910 | A * | 3/1993 | Kanno et al. | 440/89 R |
| 2010/0124858 | A1 | 5/2010 | Okabe et al. | |
| 2010/0197180 | A1 * | 8/2010 | Okabe et al. | 440/75 |
| 2010/0248564 | A1 * | 9/2010 | Okabe et al. | 440/75 |
| 2014/0031166 | A1 * | 1/2014 | Nakamura et al. | 475/343 |

OTHER PUBLICATIONS

Fukuoka et al., "Vessel Propulsion Apparatus", U.S. Appl. No. 13/786,492, filed Mar. 6, 2013.

* cited by examiner

*Primary Examiner* — Roger Pang
(74) *Attorney, Agent, or Firm* — Keating & Bennett, LLP

(57) ABSTRACT

A vessel propulsion apparatus includes a prime mover, a propeller shaft, a planetary gear train, a lower case, a cylindrical housing, and a fixing member. The planetary gear train is disposed on a propeller axis. The propeller shaft and the planetary gear train are housed in the lower case. The housing surrounds the propeller shaft about the propeller axis inside the lower case. The housing supports a sun gear such that the sun gear is not rotatable with respect to the housing. The fixing member is fixed to both the lower case and the housing.

7 Claims, 7 Drawing Sheets

VESSEL PROPULSION APPARATUS

BACKGROUND OF THE INVENTION

1. Field of the Invention

The present invention relates to a vessel propulsion apparatus.

2. Description of the Related Art

U.S. Patent Application Publication No. 2010/124858 A1 discloses an outboard motor including a bevel gear engaged with a pinion that is coupled to a drive shaft, a planetary gear train which transmits the rotation of the bevel gear to a propeller shaft, a housing in which the planetary gear train is housed, and a lower case in which the housing is housed. The propeller shaft is disposed inside and supported rotatably on the housing. The planetary gear train includes a sun gear fixed in the rotational direction by the housing.

U.S. Pat. No. 4,413,865 discloses a vessel propulsion apparatus including a bearing carrier member rotatably supporting a propeller shaft and a gear case in which the bearing carrier member is housed. The vessel propulsion apparatus further includes an anchoring member attached to the bearing carrier member and the gear case and a bolt fixing a first portion of the anchoring member to the bearing carrier member. A second end portion of the anchoring member is inserted in a recess provided in the gear case, so that the movement in the circumferential direction is restricted by the inner surface of the recess.

SUMMARY OF THE INVENTION

The inventors of preferred embodiments of the present invention described and claimed in the present application conducted an extensive study and research regarding a vessel propulsion apparatus, such as the ones described above, and in doing so, discovered and first recognized new unique challenges and previously unrecognized possibilities for improvements as described in greater detail below.

Specifically, in U.S. Patent Application Publication No. 2010/124858 A1, the planetary gear train is housed inside the housing, and the housing is in turn housed inside the lower case. Since the sun gear of the planetary gear train is fixed in the rotational direction by the housing, a high torque is applied from the sun gear to the housing when the planetary gear train transmits rotation. It is therefore necessary to fix the housing reliably to the lower case to prevent the sun gear from rotating with respect to the lower case.

In U.S. Pat. No. 4,413,865, the bearing carrier member, which rotatably supports the propeller shaft, is coupled to the gear case with the anchoring member and the bolt. However, since the anchoring member is inserted in the recess provided in the gear case, the width of the anchoring member in the circumferential (rotational) direction is smaller than the width of the recess in the circumferential direction. Accordingly, there exists a circumferential clearance gap between the outer surface of the anchoring member and the inner surface of the recess. This results in the bearing carrier member experiencing circumferential backlash with respect to the gear case.

In the structure disclosed in U.S. Pat. No. 4,413,865, the bearing carrier member is thus not fixed firmly to the gear case. Hence, even if the structure disclosed in U.S. Pat. No. 4,413,865 may be applied to the outboardmotor disclosed in U.S. Patent Application Publication No. 2010/124858 A1, the housing cannot be fixed firmly to the lower case, and therefore the fixed element of the planetary gear train cannot be fixed reliably and securely.

In order to overcome the previously unrecognized and unsolved challenges described above, a preferred embodiment of the present invention provides a vessel propulsion apparatus including a prime mover, a propeller shaft, a planetary gear train, a case, a cylindrical housing, and a fixing member. The prime mover is arranged to generate power to rotate a propeller about a propeller axis. The propeller shaft extends along the propeller axis and is arranged to transmit the rotation of the prime mover toward the propeller. The planetary gear train includes a sun gear, a ring gear, a planetary gear, and a carrier. The planetary gear train is disposed on the propeller axis and arranged to reduce the rotation transmitted to the propeller shaft. In the present preferred embodiment, "parallel" is not limited to being completely parallel, and also includes a state slightly deviated from being completely parallel, i.e., "substantially parallel". Thus, the phrase "parallel or substantially parallel" is used in this description to indicate this concept. The propeller shaft and the planetary gear train are housed in the case. The housing surrounds the propeller shaft about the propeller axis inside the case. The housing supports the planetary gear train in such a manner that one of the sun gear, the ring gear, the planetary gear, and the carrier is not rotatable with respect to the housing. The fixing member is secured or fixed to both the case and the housing, preferably via a bolt, for example.

According to this arrangement of the present preferred embodiment of the present invention, the rotation of the prime mover is transmitted through the planetary gear train and the propeller shaft to the propeller attached to the propeller shaft. The propeller shaft and the planetary gear train are housed inside the case. The housing is also housed inside the case and surrounds the propeller shaft about the propeller axis inside the case. Further, the housing supports the planetary gear train in such a manner that one of the sun gear, the ring gear, the planetary gear, and the carrier is not rotatable with respect to the housing. That is, the fixed element of the planetary gear train is fixed in the rotational direction by the housing.

Since the fixed element of the planetary gear train is supported on the housing, a high torque is applied from the fixed element of the planetary gear train to the housing when the rotation of the prime mover is transmitted to the propeller. The fixing member is bolted to both the housing and the case. Accordingly, the fixing member is fixed firmly to both the housing and the case about the propeller axis. This causes the housing to be fixed firmly to the case about the propeller axis and to be much less likely to experience backlash. The fixed element of the planetary gear train can thus be fixed reliably and securely.

The housing may support the sun gear in such a manner that the sun gear is not rotatable with respect to the housing.

The fixing member may surround the propeller shaft about the propeller axis.

The prime mover may include an internal combustion engine. In this case, the fixing member may include an inner peripheral surface defining a portion of a discharge passage to discharge exhaust gas from the internal combustion engine.

The fixing member may include an annular portion surrounding the propeller shaft about the propeller axis and at least one case fixing portion protruding radially outward from the annular portion and bolted to the case.

The fixing member may include an annular portion surrounding the propeller shaft about the propeller axis and at least one housing fixing portion protruding radially inward from the annular portion and bolted to the housing.

The fixing member may be secured or fixed to both the case and the housing from the rear of the case and the housing, preferably via a bolt, for example.

The housing may include an inner cylindrical portion surrounding the propeller shaft about the propeller axis, an outer cylindrical portion surrounding the inner cylindrical portion with a space in the radial direction of the housing, and a rib portion coupling the inner cylindrical portion and the outer cylindrical portion. In this case, the fixing member may be secured or fixed to the rib portion, preferably via a bolt, for example.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
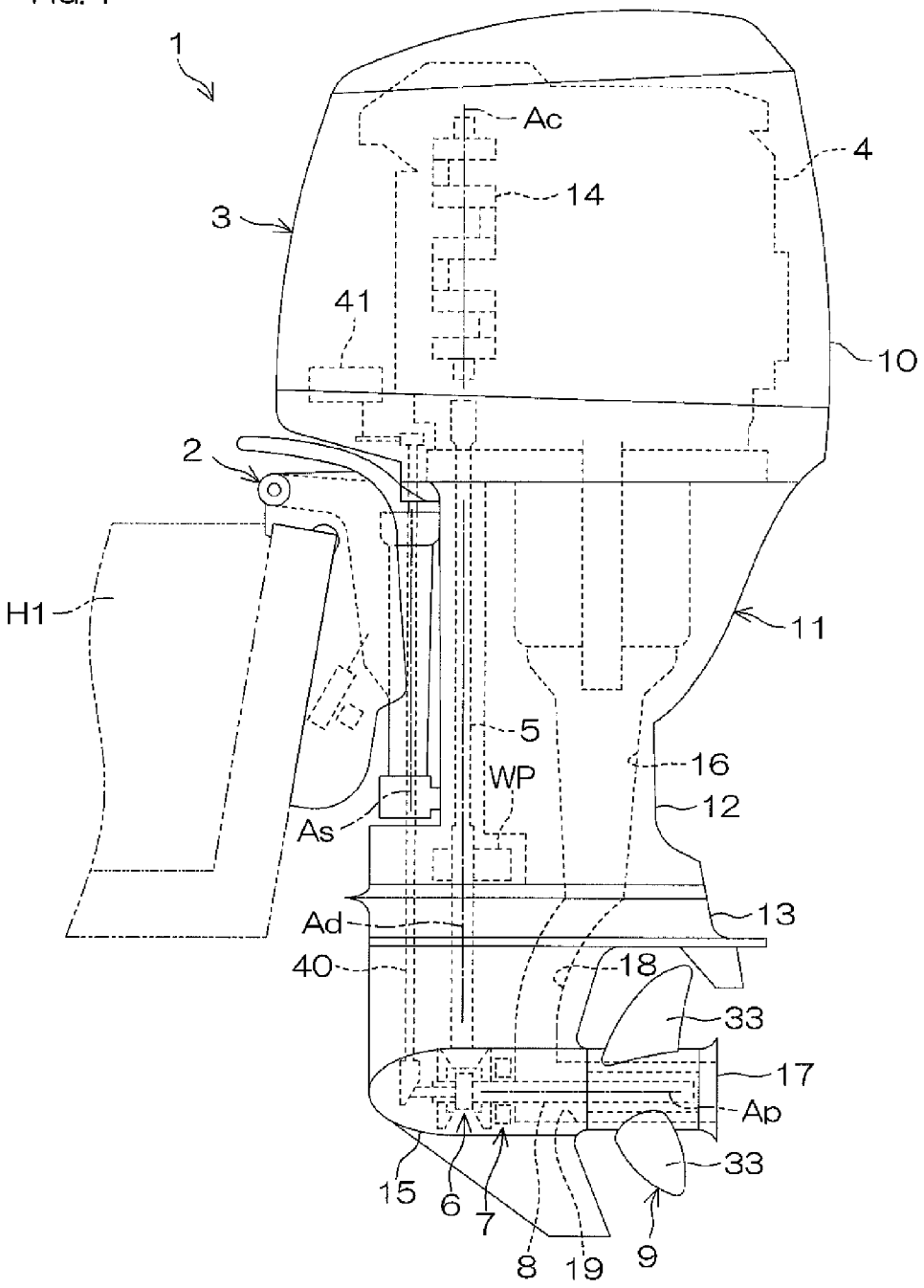
FIG. 1 is a side view of a vessel propulsion apparatus according to a preferred embodiment of the present invention.

FIG. 1 is a side view of a vessel propulsion apparatus 1 according to a preferred embodiment of the present invention.

The vessel propulsion apparatus 1 includes a bracket 2 mountable at the stern of a hull H1 and an outboard motor 3 supported on the bracket 2 in a manner rotatable about a vertically-extending steering axis As.

The outboard motor 3 includes an engine 4 arranged to generate power to rotate a propeller 9 about a propeller axis Ap, a drive shaft 5 coupled to the engine 4, a forward-reverse traveling switching mechanism 6 coupled to the drive shaft 5, a planetary gear train 7 coupled to the forward-reverse traveling switching mechanism 6, and a propeller shaft 8 coupled to the planetary gear train 7. The outboard motor 3 further includes an engine cover 10 in which the engine 4 is housed and a casing 11 in which the drive shaft 5 and other components are housed. The casing 11 includes an upper case 12 disposed below the engine cover 10 and a lower case 13 disposed below the upper case 12.

The engine 4 is an internal combustion engine including a crankshaft 14 rotatable about a vertically-extending crank axis Ac. The engine 4 is an example of a prime mover. The prime mover is not limited to the engine 4 but may be an electric motor or a combination of the engine 4 and the electric motor. The drive shaft 5, the forward-reverse traveling switching mechanism 6, the planetary gear train 7, and the propeller shaft 8 are disposed on a transmitting path to transmit the rotation of the engine 4 (rotation of the crankshaft 14) to multiple blades 33 of the propeller 9. The propeller 9 is attached detachably to the propeller shaft 8. The rotation of the engine 4 is transmitted to the propeller 9 through the drive shaft 5, the forward-reverse traveling switching mechanism 6, the planetary gear train 7, and the propeller shaft 8 in this order. This generates a thrust to propel the hull H1.

The drive shaft 5 extends downward from the engine 4. The drive shaft 5 extends vertically within the upper case 12 and the lower case 13. The drive shaft 5 is rotatable about a drive axis Ad (central axis of the drive shaft 5) with respect to the casing 11. The impeller of a water pump WP which supplies water from outside the outboard motor 3 into the engine 4 is arranged to rotate about the drive axis Ad together with the drive shaft 5. The upper end portion of the drive shaft 5 is coupled to the engine 4, while the lower end portion of the drive shaft 5 is coupled to the forward-reverse traveling switching mechanism 6. The planetary gear train 7 is disposed at the rear of the forward-reverse traveling switching mechanism 6.

The propeller shaft 8 extends rearward from the forward-reverse traveling switching mechanism 6. The planetary gear train 7 surrounds the front end portion of the propeller shaft 8. The propeller shaft 8 extends in the front-rear direction within the lower case 13. The propeller shaft 8 is rotatable about a propeller axis Ap (central axis of the propeller shaft 8) with respect to the casing 11. The lower case 13 includes a cylindrical torpedo portion 15 extending in the front-rear direction along the propeller axis Ap. The propeller shaft 8, the forward-reverse traveling switching mechanism 6, and the planetary gear train 7 are disposed in the torpedo portion 15. The rear end portion of the propeller shaft 8 protrudes rearward from the rearward-opened rear end portion of the torpedo portion 15 (see FIG. 9). The propeller 9 is disposed at the rear of the torpedo portion 15. The propeller 9 is coupled to the rear end portion of the propeller shaft 8. The propeller 9 is arranged to rotate about the propeller axis Ap together with the propeller shaft 8.

The drive shaft 5 is driven by the engine 4 in a constant rotational direction. The rotation of the drive shaft 5 is transmitted to the propeller shaft 8 through the forward-reverse traveling switching mechanism 6 and the planetary gear train 7. The forward-reverse traveling switching mechanism 6 is switched among a forward traveling state, a reverse traveling state, and a neutral state. In the forward traveling state, the forward-reverse traveling switching mechanism 6 transmits the rotation of the drive shaft 5 downstream such that the propeller shaft 8 rotates in a normal direction (e.g., clockwise in a rear view), while in the reverse traveling state, the forward-reverse traveling switching mechanism 6 transmits the rotation of the drive shaft 5 downstream such that the propeller shaft 8 rotates in a reverse direction (i.e., opposite to the normal direction). In the neutral state, the forward-reverse traveling switching mechanism 6 stops the transmission of the rotation of the drive shaft 5 to the propeller shaft 8.

The rotation of the engine 4 is transmitted to the forward-reverse traveling switching mechanism 6 through the drive shaft 5. When the forward-reverse traveling switching mechanism 6 is in the forward traveling state, the rotation in the normal direction is transmitted from the forward-reverse traveling switching mechanism 6 to the planetary gear train 7. The planetary gear train 7 reduces the rotation from the forward-reverse traveling switching mechanism 6 and transmits the reduced rotation to the propeller shaft 8. This causes the propeller shaft 8 and the propeller 9 to rotate together in the normal direction to generate a thrust to propel the hull H1 forward. When the forward-reverse traveling switching mechanism 6 is in the reverse traveling state, the rotation in the reverse direction is transmitted from the forward-reverse traveling switching mechanism 6 to the planetary gear train 7. The planetary gear train 7 reduces the rotation from the forward-reverse traveling switching mechanism 6 and transmits the reduced rotation to the propeller shaft 8. This causes the propeller shaft 8 and the propeller 9 to rotate together in the reverse direction to generate a thrust to propel the hull H1 rearward.

The outboard motor 3 includes a discharge passage 16 to discharge exhaust gas from the engine 4 through the propeller 9 into water. The discharge passage 16 is connected to the engine 4. The discharge passage 16 extends downward from the engine 4 to the propeller shaft 8 and further extends in the front-rear direction along the propeller shaft 8. The discharge passage 16 includes an exhaust port 17 opened rearward at the propeller 9. When the propeller 9 is disposed in water, the exhaust port 17 is also disposed in water. In this state, the exhaust port 17 is hence blocked by water. Exhaust gas from the engine 4 flows into the discharge passage 16 through the upstream end thereof. As the exhaust pressure in the discharge passage 16 increases, water in the exhaust port 17 is flushed out of the propeller 9 with the exhaust gas and then the exhaust gas in the discharge passage 16 is discharged out of the propeller 9 into water.

Figure 2:
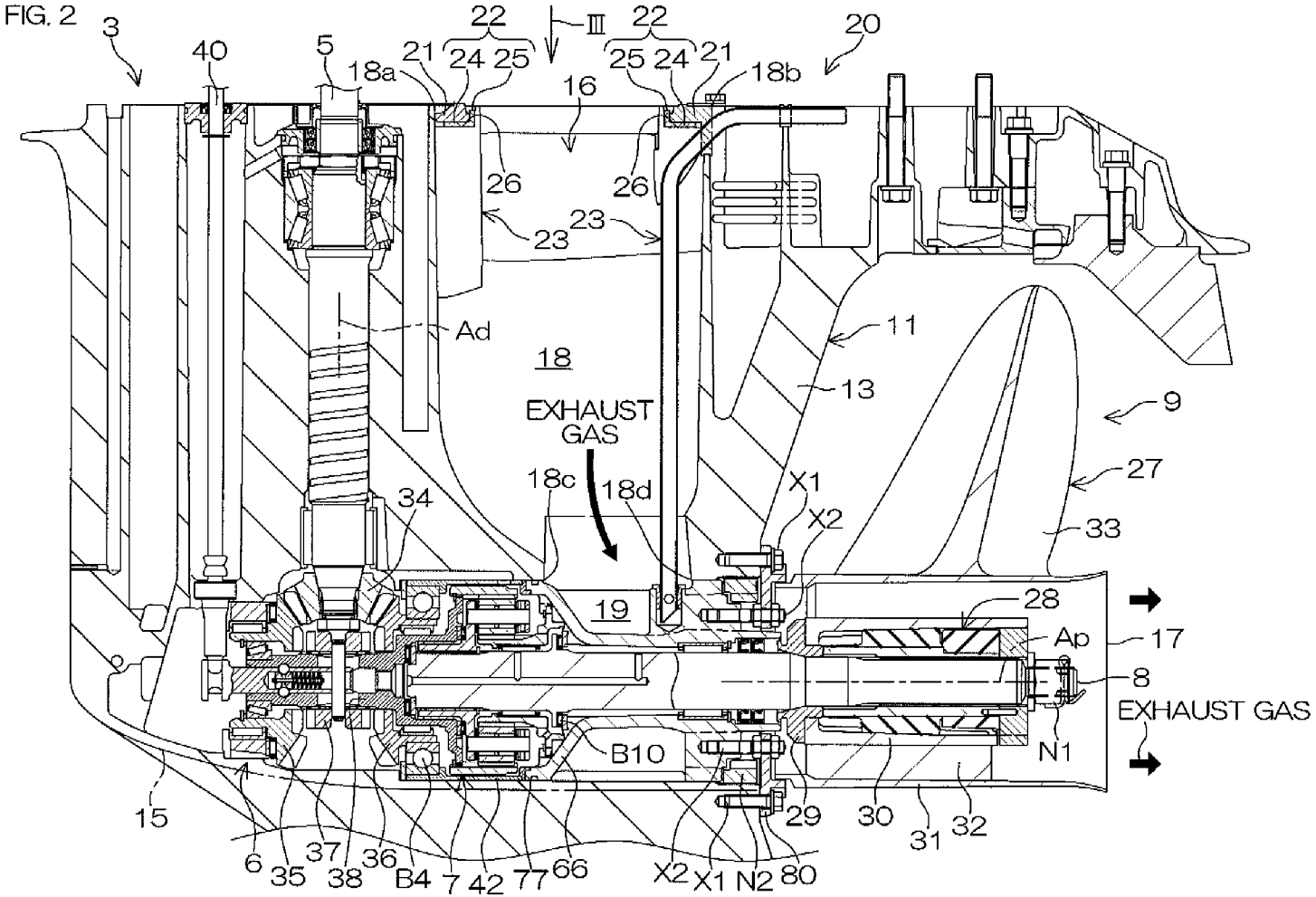
FIG. 2 is a cross-sectional view of a lower portion (lower unit) of an outboard motor.
Figure 3:
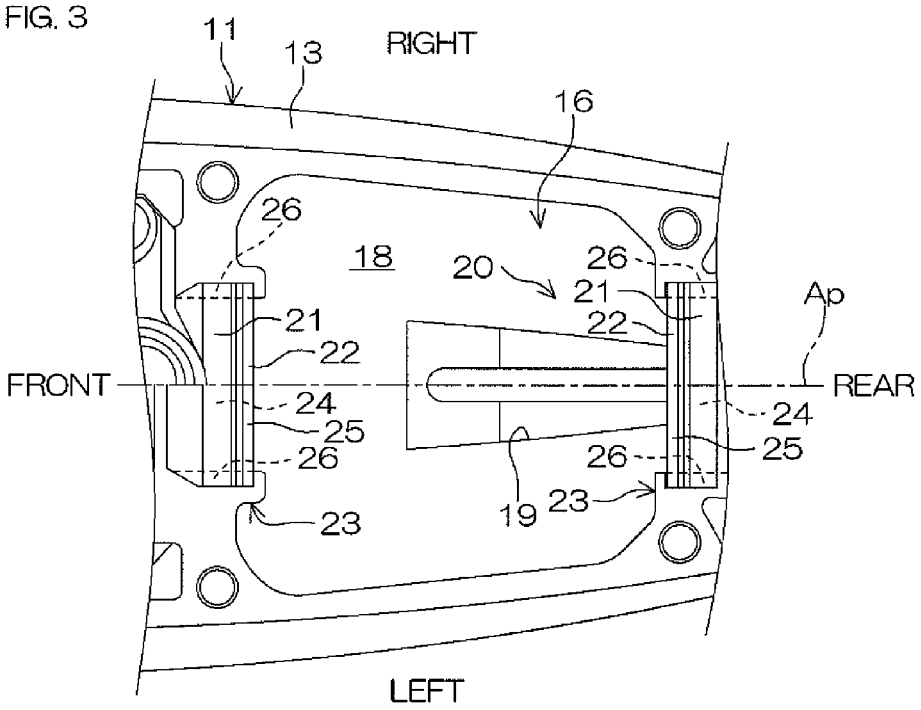
FIG. 3 shows the lower unit viewed along the arrow III in FIG. 2.

FIG. 2 is a cross-sectional view of a lower portion (lower unit) of the outboard motor 3. FIG. 3 shows the lower unit viewed along the arrow III in FIG. 2.

As shown in FIG. 2, the discharge passage 16 includes a downward guide portion 18 which guides exhaust gas from the upper case 12 downward, and a rearward guide portion 19 which guides the exhaust gas from the downward guide portion 18 rearward. The downward guide portion 18 is provided in the lower case 13 and the rearward guide portion 19 is provided in the lower case 13 and the propeller 9. The lower end portion of the downward guide portion 18 communicates with the upper end portion of the rearward guide portion 19. The front end 18*c* of the lower end portion of the downward guide portion 18 is disposed at a position more rearward than the front end 18*a* of the upper end portion of the downward guide portion 18, while the rear end 18*d* of the lower end portion of the downward guide portion 18 is disposed at a position more forward than the rear end 18*b* of the upper end portion of the downward guide portion 18. The opening area of the lower end portion (downstream end) of the downward guide portion 18 is smaller than the opening area of the upper end portion (upstream end) of the downward guide portion 18.

As shown in FIG. 2, the outboard motor 3 includes a sealing structure 20 which prevents exhaust gas from leaking from the discharge passage 16 (downward guide portion 18) at the upper end portion of the lower case 13. The sealing structure 20 includes two seals 21 disposed in the upper end portion of the downward guide portion 18 and two support brackets 22 on which the two respective seals 21 are supported. The lower case 13 includes two support portions 23 on which the two respective support brackets 22 are supported.

As shown in FIG. 2, the two seals 21 are disposed at an interval in the front-rear direction. The seals 21 are supported on the respective support brackets 22. The two support portions 23 provided in the lower case 13 are disposed at an interval in the front-rear direction. The support brackets 22 are supported on the respective support portions 23. The seals 21 are thus supported on the respective support portions 23 via the respective support brackets 22. The seals 21 are made of an elastic material such as rubber or resin. The seals 21 are pressed against a member, such as an oil pan, disposed over the lower case 13.

As shown in FIG. 3, the seals 21 extend in the right-left direction along the upper end portion of the downward guide portion 18. The support brackets 22 extend laterally along the respective seals 21. The two support brackets 22 are opposed to each other in the front-rear direction. As shown in FIG. 2, the support brackets 22 have an L-shaped or substantially L-shaped longitudinal cross section (orthogonal or substantially orthogonal to right-left direction). The front support bracket 22 is disposed in a forward and upward opened posture, while the rear support bracket 22 is disposed in a rearward and upward opened posture. The support brackets 22 each include a plate-shaped horizontal portion 24 extending laterally in a horizontal posture and a plate-shaped vertical portion 25 extending laterally in a vertical posture. The vertical portion 25 extends upward from the front end portion or the rear end portion of the horizontal portion 24. The seals 21 are each disposed on the horizontal portion 24. The seals 21 are longer than the horizontal portion 24 in the front-rear direction and longer than the vertical portion 25 in the vertical direction. The seals 21 protrude rearward or forward relative to the horizontal portion 24 and protrude upward relative to the vertical portion 25.

As shown in FIG. 2, the support portions 23 each include two downward recessed portions 26. As shown in FIG. 3, the two recessed portions 26 provided in one support portion 23 are spaced and opposed in the right-left direction to each other. One of the recessed portions 26 is provided in a right side portion of the lower case 13, while the other of the recessed portions 26 is provided in a left side portion of the lower case 13. The recessed portions 26 are opened both upward and inward. The end portions of each support bracket 22 are disposed in the two respective recessed portions 26 and supported on the bottom surfaces of the respective recessed portions 26. That is, the end portions of each support bracket 22 are supported on a pair of the recessed portions 26, while the intermediate portion of each support bracket 22 is disposed in a bridge manner. The intermediate portion of each support bracket 22 and the intermediate portion of each seal 21 are disposed in the discharge passage 16 (downward guide portion 18).

As shown in FIG. 2, the propeller 9 includes a cylindrical propeller member 27 which generates a thrust and a cylindrical damper unit 28 attached detachably to the propeller member 27. The outboard motor 3 includes a cylindrical front spacer 29 to restrict the forward movement of the propeller 9 with respect to the propeller shaft 8 and a nut N1 to fix the propeller 9 to the rear end portion of the propeller shaft 8.

As shown in FIG. 2, the propeller member 27 includes an inner cylinder 30 surrounding the damper unit 28 about the propeller axis Ap and an outer cylinder 31 concentrically surrounding the inner cylinder 30 in a manner spaced in the radial direction (orthogonal or substantially orthogonal to the propeller axis Ap) of the propeller member 27. The propeller member 27 further includes multiple ribs 32 coupling the inner cylinder 30 and the outer cylinder 31 at multiple positions separated in the circumferential direction (about the propeller axis Ap) and multiple blades 33 extending outward from the outer cylinder 31. The damper unit 28 is disposed inside the inner cylinder 30. The damper unit 28 is arranged to transmit torque about the propeller axis Ap between the propeller shaft 8 defining and serving as an input member and the inner cylinder 30 defining and serving as an output member and to absorb vibration about the propeller axis Ap between the propeller shaft 8 and the inner cylinder 30.

As shown in FIG. 2, the front end portion of the inner cylinder 30 of the propeller member 27 is supported on the propeller shaft 8 via the front spacer 29. The forward traveling thrust is transmitted from the inner cylinder 30 through the front spacer 29 to the propeller shaft 8. The inner cylinder 30 is housed in the outer cylinder 31. The front end of the inner cylinder 30 is disposed at a position more rearward than the front end of the outer cylinder 31, while the rear end of the inner cylinder 30 is disposed at a position more forward than the rear end of the outer cylinder 31. The multiple ribs 32 are disposed between the inner cylinder 30 and the outer cylinder 31 in a circumferentially spaced manner. The ribs 32 each have a plate-shaped configuration extending radially from the outer peripheral surface of the inner cylinder 30 to the inner peripheral surface of the outer cylinder 31. The multiple blades 33 are disposed around the outer cylinder 31. The multiple blades 33 are disposed in a circumferentially spaced manner. The inner cylinder 30, the outer cylinder 31, the ribs 32, and the blades 33 are arranged to rotate integrally about the propeller axis Ap. The multiple blades 33 are arranged to rotate about the propeller axis Ap to generate a thrust.

As shown in FIG. 2, the outer peripheral surface of the inner cylinder 30 and the inner peripheral surface of the outer cylinder 31 are spaced and opposed radially to each other. The multiple ribs 32 are disposed between the inner cylinder 30 and the outer cylinder 31 in a circumferentially spaced manner. The outer peripheral surface of the inner cylinder 30, the inner peripheral surface of the outer cylinder 31, and the multiple ribs 32 define a portion of the rearward guide portion 19. Further, the rear end portion of the outer cylinder 31 defines the rearward-opened exhaust port 17. Exhaust gas from the engine 4 is guided through the downward guide portion 18 of the discharge passage 16 into the propeller member 27 from the front of the propeller member 27. The exhaust gas guided into the propeller member 27 then flows rearward through the cylindrical space between the inner cylinder 30 and the outer cylinder 31 to be discharged rearward through the rear end portion of the outer cylinder 31 (exhaust port 17). The exhaust gas from the engine 4 is thus discharged out of the propeller 9 into water.

Figure 4:
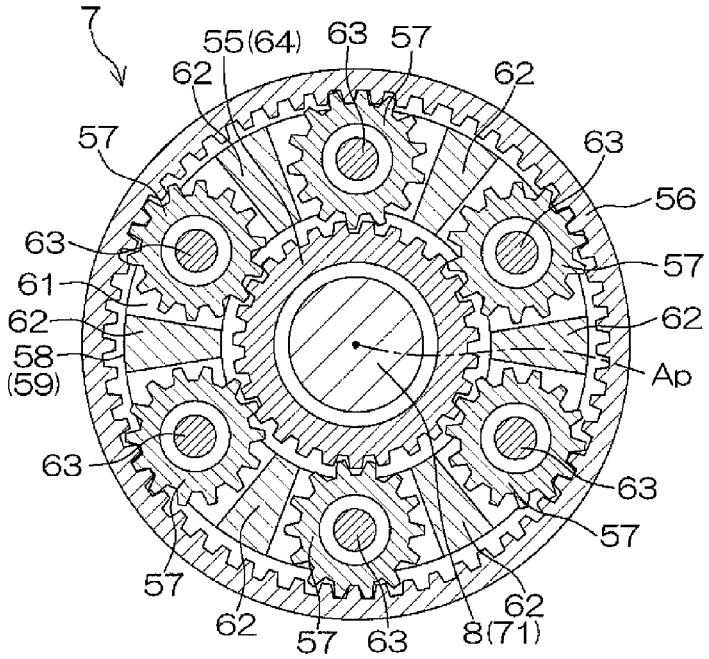
FIG. 4 is a cross-sectional view of a planetary gear train taken along line IV-IV in FIG. 5.
Figure 5:
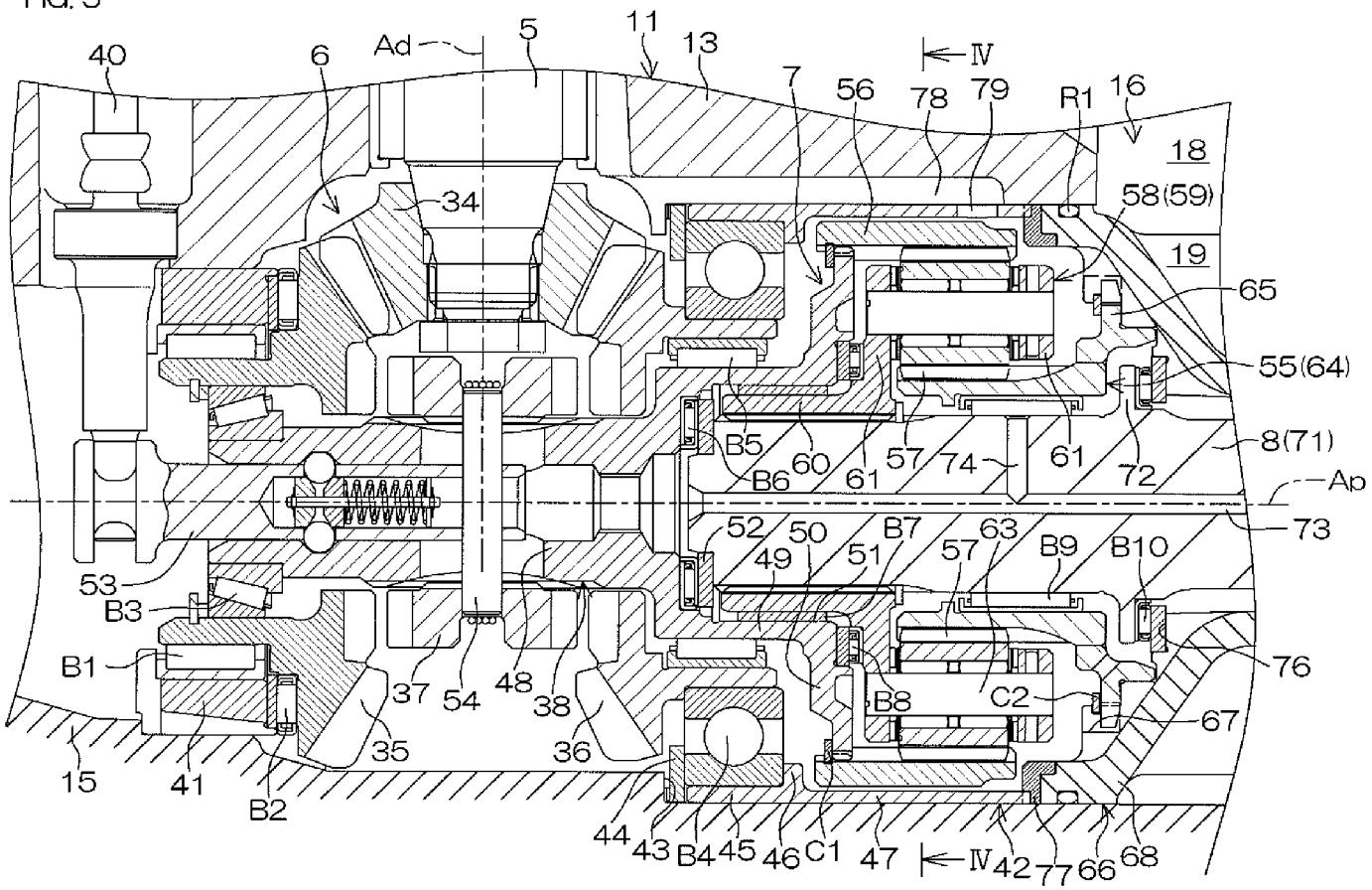
FIG. 5 is a cross-sectional view showing a forward-reverse traveling switching mechanism and the planetary gear train.

FIG. 4 is a cross-sectional view of the planetary gear train 7 taken along line IV-IV in FIG. 5. FIG. 5 is a cross-sectional view showing the forward-reverse traveling switching mechanism 6 and the planetary gear train 7.

As shown in FIG. 5, the forward-reverse traveling switching mechanism 6 includes a pinion 34 rotatable about the drive axis Ad together with the drive shaft 5, cylindrical front and rear gears 35, 36 engaged with the pinion 34, and a cylindrical dog clutch 37 to be engaged selectively with one of the front and rear gears 35, 36. The forward-reverse traveling switching mechanism 6 further includes a transmitting shaft 38 to transmit the rotation of the dog clutch 37 to the planetary gear train 7. The outboard motor 3 includes a shift actuator 39 disposed inside the engine cover 10 (see FIG. 1) and a shift rod 40 to transmit power of the shift actuator 39 to the dog clutch 37. The forward-reverse traveling switching mechanism 6 is switched selectively among the forward traveling state, reverse traveling state, and neutral state by the shift actuator 39.

As shown in FIG. 5, the pinion 34, the front gear 35, and the rear gear 36 are bevel gears. The pinion 34 is coupled to the lower end portion of the drive shaft 5. The pinion 34 is held in a posture in which the tooth portion faces downward. The front gear 35 and the rear gear 36 are coupled to the lower case 13. The front gear 35 is held in a posture in which the tooth portion faces rearward, while the rear gear 36 is held in a posture in which the tooth portion faces forward. The front gear 35 is disposed at a position more forward than the drive axis Ad, while the rear gear 36 is disposed at a position more rearward than the drive axis Ad. The front gear 35 and the rear gear 36 are thus spaced in the front-rear direction and opposed in the front-rear direction to each other. The dog clutch 37 is disposed between the front gear 35 and the rear gear 36. The dog clutch 37 is positioned below the pinion 34. The front gear 35, the rear gear 36, the dog clutch 37, and the transmitting shaft 38 are disposed on the propeller axis Ap. The transmitting shaft 38 is inserted through the front gear 35, the rear gear 36, and the dog clutch 37.

As shown in FIG. 5, the front gear 35 is supported on a bearing B1 surrounding the front gear 35 about the propeller axis Ap and a bearing B2 surrounding the front gear 35 about the propeller axis Ap at a position more rearward than the bearing B1 in a manner rotatable about the propeller axis Ap. The front end portion of the front gear 35 is inserted through the bearing B1. The outboard motor 3 includes a cylindrical front adapter 41 supporting the bearings B1, B2. The front adapter 41 extends in the front-rear direction along the propeller axis Ap. The bearing B1 is inserted in the adapter 41. The bearing B2 is disposed between the rear end portion of the front adapter 41 and the tooth portion of the front gear 35. The front adapter 41 is inserted in the torpedo portion 15 and held by the lower case 13. The front gear 35 is thus held by the lower case 13 via the bearings B1, B2 and the front adapter 41. The front gear 35 is rotatable about the propeller axis Ap with respect to the lower case 13.

As shown in FIG. 5, the rear gear 36 is supported on a bearing B4 surrounding the front gear 35 about the propeller axis Ap in a manner rotatable about the propeller axis Ap. The rear end portion of the rear gear 36 is inserted through the bearing B4. The outboard motor 3 includes a cylindrical front housing 42 supporting the bearing B4. The front housing 42 extends in the front-rear direction along the propeller axis Ap. The front housing 42 is disposed in the torpedo portion 15. The bearing B4 is inserted in the front housing 42. The front housing 42 is inserted in the torpedo portion 15 and held by the lower case 13. The rear gear 36 is thus held by the lower case 13 via the bearing B4 and the front housing 42. The rear gear 36 is rotatable about the propeller axis Ap with respect to the lower case 13.

The bearing B4, which defines and serves as a front bearing, is an antifriction bearing such as a ball bearing or a roller bearing. The bearing B4 may be a radial bearing or an angular bearing. FIG. 5 shows the case where the bearing B4 is a radial ball bearing. As shown in FIG. 5, the bearing B4 is disposed at a position more rearward than the tooth portion of the rear gear 36. The bearing B4 has an outside diameter greater than that of the rear gear 36. The bearing B4 includes an outer race, an inner race, and multiple rolling elements disposed between the outer race and the inner race. The outer race of the bearing B4 is disposed at the rear of an annular stepped portion 43 provided on the inner peripheral portion of the torpedo portion 15. The stepped portion 43 is disposed around the rear gear 36 and includes a rearward-facing annular stepped surface. The front end portion of the outer race of the bearing B4 is supported from the front on the stepped portion 43 via a ring washer 44 disposed around the rear gear 36. The forward movement of the bearing B4 is thus restricted with respect to the lower case 13.

As shown in FIG. 5, the front housing 42 extends rearward from the outer race of the bearing B4. The front housing 42 supports the bearing B4 and therefore supports the rear gear 36 via the bearing B4. The planetary gear train 7 is disposed at the rear of the bearing B4. The front housing 42 surrounds the planetary gear train 7 about the propeller axis Ap to house the planetary gear train 7 therein. The planetary gear train 7 surrounds the front end portion of the propeller shaft 8. The front end portion of the propeller shaft 8 is thus disposed inside the front housing 42.

As shown in FIG. 5, the front housing 42 includes a cylindrical gear support portion 45 extending in the front-rear direction along the propeller axis Ap, an annular locking portion 46 disposed at the rear of the gear support portion 45, and a cylindrical interposed portion 47 extending rearward from the locking portion 46.

As shown in FIG. 5, the gear support portion 45 surrounds the bearing B4 about the propeller axis Ap. The locking portion 46 is disposed at the rear of the bearing B4. The locking portion 46 protrudes radially inward relative to the inner peripheral surface of the gear support portion 45. The locking portion 46 is opposed to the rear end surface of the bearing B4. The gear support portion 45 and the locking portion 46 define a step on which the outer race of the bearing B4 is held. The outer race of the bearing B4 is fitted into the gear support portion 45 and supported from the rear on the front end surface of the locking portion 46. The interposed portion 47 is disposed at a position more rearward than the bearing B4. The interposed portion 47 surrounds the planetary gear train 7 about the propeller axis Ap. The locking portion 46 is disposed between the gear support portion 45 and the interposed portion 47 in the front-rear direction.

As shown in FIG. 5, the gear support portion 45, the locking portion 46, and the interposed portion 47 have the same or substantially the same outside diameter. On the other hand, the gear support portion 45 has an inside diameter greater than that of the locking portion 46 and the interposed portion 47 has an inside diameter greater than that of the gear support portion 45. Accordingly, the rear end of the front housing 42 has an inside diameter greater than that of the gear support portion 45. The front housing 42 includes an outer peripheral surface having a constant diameter from the front end to the rear end and a stepwise inner peripheral surface having a diameter that varies in a stepwise manner. The radial thickness of the interposed portion 47 is smallest among the gear support portion 45, the locking portion 46, and the interposed portion 47, while the radial thickness of the locking portion 46 is greatest among the gear support portion 45, the locking portion 46, and the interposed portion 47. The length of the interposed portion 47 in the front-rear direction is greatest among the gear support portion 45, the locking portion 46, and the interposed portion 47, while the length of the locking portion 46 in the front-rear direction is smallest among the gear support portion 45, the locking portion 46, and the interposed portion 47.

As shown in FIG. 5, the transmitting shaft 38 of the forward-reverse traveling switching mechanism 6 includes a cylindrical smaller diameter portion 48 extending in the front-rear direction along the propeller axis Ap, a cylindrical greater diameter portion 49 extending in the front-rear direction along the propeller axis Ap at a position more rearward than the smaller diameter portion 48, and an annular flange portion 50 extending radially outward from the rear end portion of the greater diameter portion 49. The smaller diameter portion 48, the greater diameter portion 49, and the flange portion 50 are coaxial. The greater diameter portion 49 has an outside diameter greater than that of the smaller diameter portion 48 and the flange portion 50 has an outside diameter greater than that of the greater diameter portion 49. The flange portion 50 has a plate-shaped configuration continuing through the whole circumference. The greater diameter portion 49 and the flange portion 50 define a columnar recessed portion 51 recessed forward at the center of the rear end surface of the flange portion 50. The front end portion of the propeller shaft 8 is disposed in the recessed portion 51. The front end portion of the propeller shaft 8 is supported from the front on the transmitting shaft 38 via a bearing B6 and a washer 52 disposed between the bottom surface of the recessed portion 51 and the front end surface of the propeller shaft 8. The transmitting shaft 38 and the propeller shaft 8 are relatively rotatable about the propeller axis Ap.

As shown in FIG. 5, the transmitting shaft 38 is inserted through the front gear 35, the rear gear 36, and the dog clutch 37. The rear gear 36 surrounds a portion at which the smaller diameter portion 48 and the greater diameter portion 49 are joined. The smaller diameter portion 48 protrudes forward from the rear gear 36. The front gear 35 and the dog clutch 37 surround the smaller diameter portion 48. The front gear 35 rotatably supports the transmitting shaft 38 via a bearing B3 disposed in the front gear 35. Similarly, the rear gear 36 rotatably supports the transmitting shaft 38 via a bearing B5 disposed in the rear gear 36. The transmitting shaft 38 is rotatable about the propeller axis Ap with respect to the front gear 35 and the rear gear 36. Meanwhile, the inner peripheral portion of the dog clutch is spline-coupled with the outer peripheral portion of the transmitting shaft 38. Accordingly, the dog clutch 37 is movable in the front-rear direction with respect to the transmitting shaft 38 and is rotatable about the propeller axis Ap together with the transmitting shaft 38.

As shown in FIG. 5, the dog clutch 37 is movable in the axial direction (along the propeller axis) with respect to the transmitting shaft 38 between a forward traveling position at which the front end portion of the dog clutch 37 is engaged with the front gear 35 and a reverse traveling position at which the rear end portion of the dog clutch 37 is engaged with the rear gear 36. The position (shown in FIG. 5) between the forward traveling position and the reverse traveling position is a neutral position at which the dog clutch 37 is engaged neither with the front gear 35 nor with the rear gear 36. The dog clutch 37 is coupled to the shift rod 40 via a slide shaft 53 protruding forward from the front end portion of the transmitting shaft 38 and a coupling pin 54 protruding radially from the outer peripheral surface of the transmitting shaft 38. The power of the shift actuator 39 (see FIG. 1) is transmitted to the dog clutch 37 via the shift rod 40, the slide shaft 53, and the coupling pin 54. The shift actuator 39 is arranged to shift the dog clutch 37 to the forward traveling position, reverse traveling position, or neutral position.

The drive shaft 5 is driven by the engine 4 in a predetermined rotational direction. The pinion 34 is arranged to rotate about the drive axis Ad together with the drive shaft 5. The front gear 35 and the rear gear 36 are arranged to rotate in their respective different directions with the rotation of the pinion 34. When the dog clutch 37 is in the forward traveling position and the front gear 35 rotates, the rotation of the front gear 35 is transmitted through the dog clutch 37 to the transmitting shaft 38. The rotation transmitted to the transmitting shaft 38 is then transmitted through the planetary gear train 7 to the propeller shaft 8. This causes the propeller 9 to rotate in the normal direction. On the other hand, when the dog clutch 37 is in the reverse traveling position and the rear gear 36 rotates, the rotation of the rear gear 36 is transmitted through the dog clutch 37 to the transmitting shaft 38. This causes the propeller 9 to rotate in the reverse direction. When the dog clutch 37 is in the neutral position, the rotation of the drive shaft 5 is not transmitted to the transmitting shaft 38 so as to be idle.

As shown in FIG. 5, the planetary gear train 7 couples the transmitting shaft 38 of the forward-reverse traveling switching mechanism 6 and the propeller shaft 8. The planetary gear train 7 is disposed on the propeller axis Ap. The planetary gear train 7 is also disposed in front of a bearing B10 defining and serving as a rear bearing. The planetary gear train 7 is disposed between the rear gear 36 and the bearing B10 in the front-rear direction. The bearing B10 is an antifriction bearing such as a ball bearing or a roller bearing. The bearing B10 may be a radial bearing, a thrust bearing, or an angular bearing. FIG. 5 shows the case where the bearing B10 is a thrust roller bearing.

As shown in FIG. 4, the planetary gear train 7 includes a sun gear 55, a ring gear 56, multiple planetary gears 57, and a carrier 58. The sun gear 55 is fixed circumferentially with respect to the lower case 13, while the planetary gears 57, the ring gear 56, and the carrier 58 are rotatable about the propeller axis Ap with respect to the lower case 13.

As shown in FIG. 4, the sun gear 55 surrounds the propeller shaft 8 about the propeller axis Ap. The multiple planetary gears 57 are disposed around the sun gear 55. The planetary gears 57 are engaged with a tooth portion provided on the outer peripheral portion of the sun gear 55. The planetary gears 57 are rotatable about their respective central axes parallel or substantially parallel to the propeller axis Ap and also rotatable about the propeller axis Ap along the outer periphery of the sun gear 55. The ring gear 56 surrounds the multiple planetary gears 57 about the propeller axis Ap. A tooth portion provided on the inner peripheral portion of the ring gear 56 is engaged with the planetary gears 57. The ring gear 56 is rotatable about the propeller axis Ap. The multiple planetary gears 57 are arranged to transmit the rotation about the propeller axis Ap between the sun gear 55 and the ring gear 56.

As shown in FIG. 5, the ring gear 56 is housed in the front housing 42. The ring gear 56 extends in the front-rear direction along the propeller axis Ap. The front end portion of the ring gear 56 is disposed at the rear of the locking portion 46 of the front housing 42, while the rear end portion of the ring gear 56 is disposed at a position more forward than the rear end portion of the front housing 42. The ring gear 56 constitutes the outer peripheral portion of the planetary gear train 7. The outside diameter of the ring gear 56 is equivalent to the maximum diameter of the planetary gear train 7. The outside diameter of the ring gear 56, that is, the maximum diameter of the planetary gear train 7 is smaller than the inside diameter of the interposed portion 47, but greater than the inside diameter of the locking portion 46. The ring gear 56 has an inside diameter smaller than that of the locking portion 46.

As shown in FIG. 5, the ring gear 56 surrounds the flange portion 50 of the transmitting shaft 38 about the propeller axis Ap. The forward movement of the flange portion 50 with respect to the ring gear 56 is restricted by a clip C1 disposed inside the front end portion of the ring gear 56. The transmitting shaft 38 includes multiple teeth provided on the outer peripheral portion of the flange portion 50. The multiple teeth are disposed in a circumferentially spaced manner and protrude radially outward. The multiple teeth provided on the outer peripheral portion of the flange portion 50 are engaged with multiple teeth provided on the inner peripheral portion of the ring gear 56. This allows the ring gear 56 and the transmitting shaft 38 to rotate integrally about the propeller axis Ap and thus the rotation of the transmitting shaft 38 to be transmitted to the ring gear 56.

As shown in FIG. 5, the carrier 58 is surrounded by the ring gear 56 about the propeller axis Ap. The carrier 58 is housed in the front housing 42, but protrudes partially rearward from the front housing 42. The carrier 58 includes a cylindrical holding portion 59 holding the multiple planetary gears 57 and a cylindrical joint portion 60 joined with the propeller shaft 8. The holding portion 59 is disposed at a position more rearward than the joint portion 60. The holding portion 59 and the joint portion 60 surround the propeller shaft 8 about the propeller axis Ap.

As shown in FIG. 5, the holding portion 59 of the carrier includes two circular disk portions 61 disposed parallel or substantially parallel to each other at an interval in the front-rear direction. As shown in FIG. 4, the holding portion 59 further includes multiple pillar portions 62 coupling the two circular disk portions 61 at multiple positions separated in the circumferential direction. The two circular disk portions 61 surround the propeller shaft 8 about the propeller axis Ap. The front circular disk portion 61 is disposed at the rear of the flange portion 50 of the transmitting shaft 38, while the rear circular disk portion 61 is disposed at a position more rearward than the ring gear 56. As shown in FIG. 4, the planetary gears and the pillar portions 62 are disposed alternately in the circumferential direction. The planetary gears 57 are held by the holding portion 59 via a center shaft 63 the end portions of which are supported on the two circular disk portions 61.

As shown in FIG. 5, the holding portion 59 of the carrier 58 is supported on the transmitting shaft 38 via a bearing B8 disposed between the front circular disk portion 61 and the flange portion 50 of the transmitting shaft 38. The joint portion 60 of the carrier 58 extends forward from the inner peripheral portion of the front circular disk portion 61. The joint portion 60 is disposed in the recessed portion 51 provided in the transmitting shaft 38. The joint portion 60 is supported on the inner peripheral surface of the recessed portion 51 via a cylindrical bushing B7 (sliding bearing) inserted in the recessed portion 51. As mentioned above, the bottom portion of the recessed portion 51 holds the bearing B6. Accordingly, the carrier 58 is supported on the transmitting shaft 38 via the bushing B7 and the bearing B6. The carrier 58 is rotatable about the propeller axis Ap with respect to the transmitting shaft 38. On the other hand, the inner peripheral portion of the joint portion 60 is spline-coupled with the outer peripheral portion of the propeller shaft 8. The carrier 58 and the propeller shaft 8 are thus rotatable integrally about the propeller axis Ap.

As shown in FIG. 5, the sun gear 55 includes a cylindrical tooth portion 64 extending in the front-rear direction along the propeller axis Ap and an annular fixing portion 65 extending radially outward from the rear end portion of the tooth portion 64. The multiple planetary gears 57 are disposed around the tooth portion 64 and engaged with the outer peripheral portion of the tooth portion 64. The inner peripheral portion of the tooth portion 64 supports the propeller shaft 8 via a bearing B9. The propeller shaft 8 is rotatable about the propeller axis Ap with respect to the sun gear 55. The tooth portion 64 is disposed in the holding portion 59 of the carrier 58. The rear end portion of the tooth portion 64 is disposed at a position more rearward than the carrier 58 and the front housing 42. The fixing portion 65 is thus disposed at a position more rearward than the carrier 58 and the front housing 42.

As shown in FIG. 5, the outboardmotor 3 includes a cylindrical rear housing 66 to fix the sun gear 55 in the circumferential direction. The rear housing 66 is disposed at a position more rearward than the front housing 42. The interposed portion 47 of the front housing 42 is disposed between the gear support portion 45 of the front housing 42 and the rear housing 66 in the front-rear direction. The rear housing 66 extends in the front-rear direction along the propeller axis Ap to surround the propeller shaft 8 about the propeller axis Ap. The fixing portion 65 of the sun gear 55 is inserted in the front end portion of the rear housing 66. The rear housing 66 includes a fitting portion 67 provided on the inner peripheral portion thereof. The fixing portion 65 is fitted into the fitting portion 67. The forward movement of the fixing portion 65 with respect to the rear housing 66 is restricted by a clip C2 disposed inside the front end portion of the rear housing 66.

As shown in FIG. 5, the sun gear 55 includes multiple teeth provided on the outer peripheral portion of the fixing portion 65. The rear housing 66 includes multiple grooves provided in the inner peripheral portion of the fitting portion 67. The multiple teeth are disposed in a circumferentially spaced manner and protrude radially outward. The multiple grooves are disposed in a circumferentially spaced manner and recessed radially inward. The multiple teeth are disposed in the respective multiple grooves, so that the fixing portion 65 and the fitting portion 67 are engaged with each other. The engagement between the fixing portion 65 and the fitting portion 67 causes the sun gear 55 to be fixed circumferentially with respect to the rear housing 66.

The rear housing 66 thus supports the sun gear 55 in such a manner that the sun gear 55 cannot rotate with respect to the rear housing 66. That is, the sun gear 55 is fixed circumferentially with respect to the rear housing 66. The rear housing 66 is also fixed circumferentially with respect to the lower case 13. Accordingly, the sun gear 55 is fixed about the propeller axis Ap with respect to the lower case 13, while the planetary gears 57, the ring gear 56, and the carrier 58 are rotatable about the propeller axis Ap with respect to the lower case 13.

As mentioned above, the rotation of the drive shaft 5 is transmitted through the transmitting shaft 38 to the ring gear 56. Since the sun gear 55 is fixed about the propeller axis Ap with respect to the lower case 13, the rotation of the ring gear 56 causes the planetary gears 57 to rotate about its central axis and, at the same time, to rotate about the propeller axis Ap along the outer peripheral portion of the sun gear 55, as can be seen in FIG. 4. This also causes the carrier 58 to rotate about the propeller axis Ap. As shown in FIG. 5, the carrier 58 is spline-coupled with the propeller shaft 8. Accordingly, the rotation of the ring gear 56 causes the propeller shaft 8 to rotate at a speed lower than that of the ring gear 56. The rotation of the drive shaft 5 is thus transmitted to the propeller shaft 8 through the forward-reverse traveling switching mechanism 6 and the planetary gear train 7.

Figure 6:
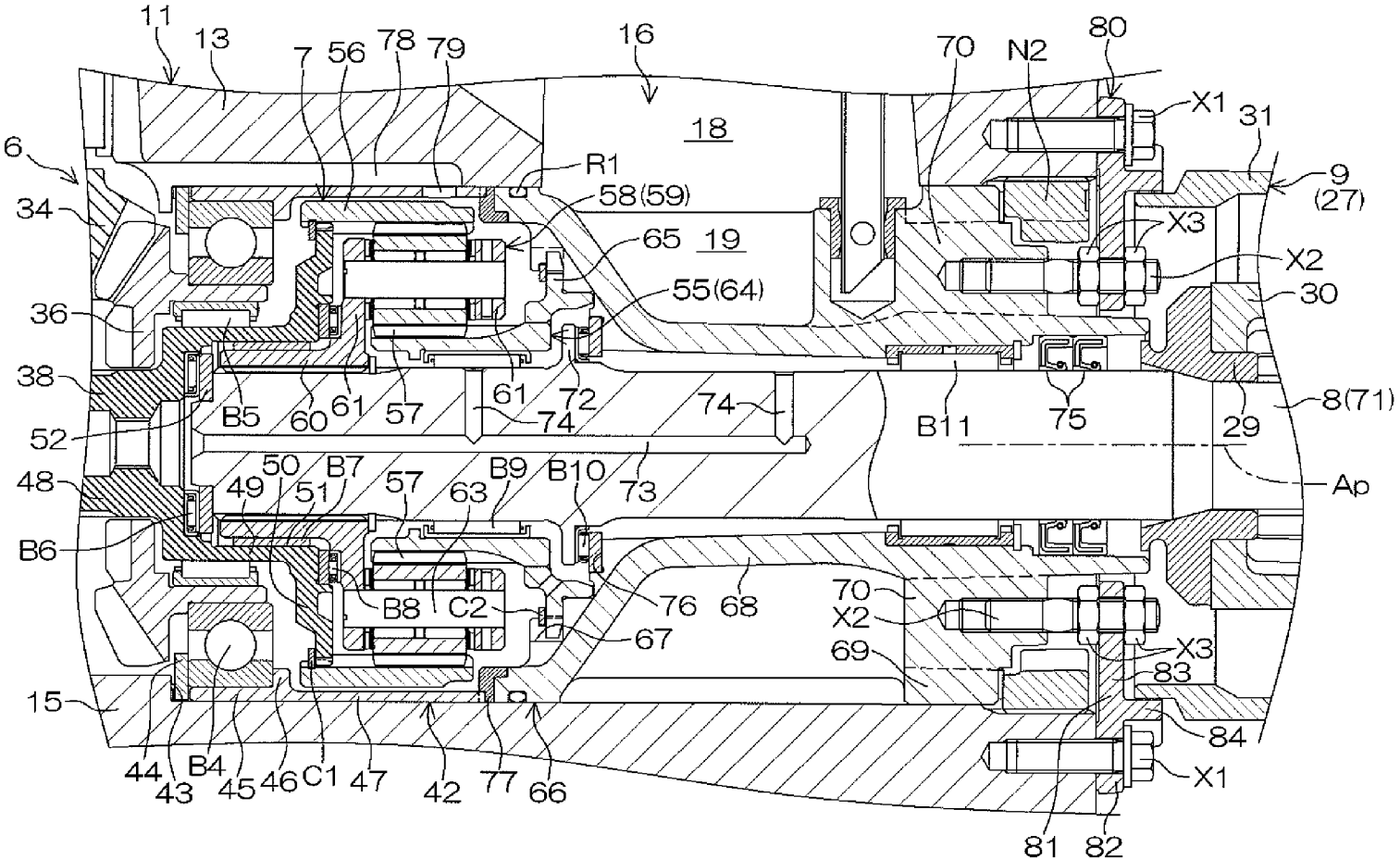
FIG. 6 is a cross-sectional view showing a front housing, a spacer, and a rear housing.
Figure 7:
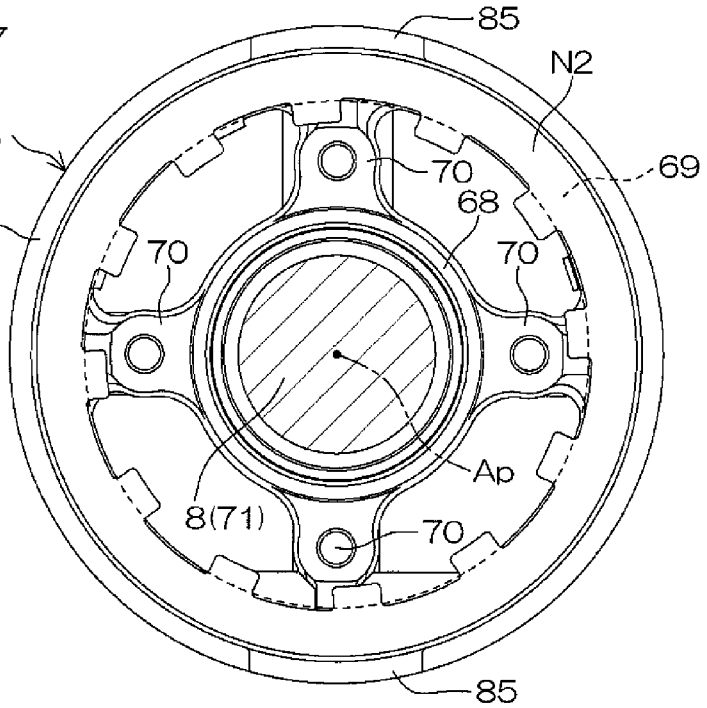
FIG. 7 shows, in a rear view, a ring nut attached to a lower case.

FIG. 6 is a cross-sectional view showing the front housing 42, a spacer 77, and the rear housing 66. FIG. 7 shows, in a rear view, a ring nut N2 attached to the lower case 13.

As shown in FIG. 6, the rear housing 66 is disposed in the torpedo portion 15 of the lower case 13. The rear housing 66 extends in the front-rear direction along the propeller axis Ap. The rear housing 66 has a funnel shape in which the opening area of the front end is greater than that of the rear end. The rear end portion of the rear housing 66 preferably includes a double tube configuration. Specifically, the rear housing 66 includes an inner cylindrical portion 68 extending in the front-rear direction along the propeller axis Ap, an outer cylindrical portion 69 surrounding the rear end portion of the inner cylindrical portion 68 about the propeller axis Ap with a space in the radial direction, and multiple rib portions 70 coupling the inner cylindrical portion 68 and the outer cylindrical portion 69 at multiple positions separated in the circumferential direction.

As shown in FIG. 6, the inner cylindrical portion 68 is longer than the outer cylindrical portion 69 in the front-rear direction. The outer cylindrical portion 69 surrounds the rear end portion of the inner cylindrical portion 68 about the propeller axis Ap. The front end portion of the inner cylindrical portion 68 is disposed at a position more forward than the front end portion of the outer cylindrical portion 69, while the rear end portion of the inner cylindrical portion 68 is disposed at a position more rearward than the rear end portion of the outer cylindrical portion 69. As shown in FIG. 7, the rib portions 70 extend radially from the outer peripheral surface of the inner cylindrical portion 68 to the inner peripheral surface of the outer cylindrical portion 69. The multiple rib portions 70 are disposed between the inner cylindrical portion 68 and the outer cylindrical portion 69 in a circumferentially spaced manner.

As shown in FIG. 6, the inner cylindrical portion 68 is disposed below the downward guide portion 18, a portion of the discharge passage 16. The inner cylindrical portion 68, the outer cylindrical portion 69, and the rib portions 70 define the rearward guide portion 19, a portion of the discharge passage 16. Exhaust gas guided through the downward guide portion 18 to the vicinity of the inner cylindrical portion 68 flows rearward along the outer peripheral surface of the inner cylindrical portion 68 to pass through between the outer peripheral surface of the inner cylindrical portion 68 and the inner peripheral surface of the outer cylindrical portion 69. The exhaust gas passing through between the inner cylindrical portion 68 and the outer cylindrical portion 69 flows through the propeller 9 to be discharged rearward out of the propeller 9.

As shown in FIG. 6, the inner cylindrical portion 68 of the rear housing 66 preferably has a funnel shape in which the opening area of the front end is greater than that of the rear end. The outside and inside diameters of the front end of the inner cylindrical portion 68 are greater than the outside and inside diameters of the rear end of the inner cylindrical portion 68. The inside diameter of the front end of the inner cylindrical portion 68, that is, the inside diameter of the front end of the rear housing 66 is smaller than that of the gear support portion 45 of the front housing 42. The front end portion of the inner cylindrical portion 68 is disposed at a position more forward than the lower end portion of the downward guide portion 18, while the rear end portion of the inner cylindrical portion 68 is disposed at a position more rearward than the lower end portion of the downward guide portion 18. The clearance gap between the front end portion of the inner cylindrical portion 68 and the inner peripheral surface of the torpedo portion 15 is hermetically sealed with an O-ring R1. The front end of the outer cylindrical portion 69 is disposed below the lower end portion of the downward guide portion 18 and the rear end of the outer cylindrical portion 69 is disposed at a position more rearward than the lower end portion of the downward guide portion 18. Similarly, the front end of each rib portion 70 is disposed below the lower end portion of the downward guide portion 18 and the rear end of each rib portion 70 is disposed at a position more rearward than the lower end portion of the downward guide portion 18.

As shown in FIG. 6, the propeller shaft 8 penetrates the inner cylindrical portion 68 of the rear housing 66 in the front-rear direction. The propeller shaft 8 includes a shaft portion 71 extending in the front-rear direction along the propeller axis Ap and an annular flange portion 72 extending radially outward from the shaft portion 71. The shaft portion 71 extends in the front-rear direction from the recessed portion 51 provided in the transmitting shaft 38 posterior to the lower case 13. Lubricant oil passes through a collective flow passage 73 extending rearward from the front end surface of the shaft portion 71 and multiple branched flow passages 74 extending from the collective flow passage 73 to the outer peripheral surface of the shaft portion 71 and flows between the forward-reverse traveling switching mechanism 6 and the shaft portion 71. The flange portion 72 is disposed inside the front end portion of the inner cylindrical portion 68. The flange portion 72 is disposed at the rear of the tooth portion 64 of the sun gear 55 and surrounded by the fixing portion 65 of the sun gear 55.

As shown in FIG. 6, the outboard motor 3 includes the bearing B10 disposed inside the front end portion of the inner cylindrical portion 68 of the rear housing 66, a bearing B11 disposed inside the rear end portion of the inner cylindrical portion 68, and a seal ring 75 hermetically sealing the gap between the propeller shaft 8 and the inner cylindrical portion 68 at the rear of the bearing B11. The bearings B10, B11 and the seal ring 75 surround the shaft portion 71 about the propeller axis Ap. The bearings B10, B11 are disposed at an interval in the front-rear direction. The bearing B10 is disposed at the rear of the flange portion 72 of the propeller shaft 8. The inner cylindrical portion 68 includes an annular stepped portion 76 disposed at the rear of the bearing B10. The bearing B10 is disposed between the flange portion 72 and the stepped portion 76. The rear housing 66 supports from the rear the flange portion 72 via the bearing B10. The rear housing 66 further supports radially the shaft portion 71 via the bearing B11.

As shown in FIG. 6, the outboard motor 3 includes the ring nut N2 attached to the rear end portion of the torpedo portion 15 and an annular spacer 77 interposed between the rear end of the front housing 42 and the front end of the rear housing 66.

As shown in FIG. 6, the ring nut N2 is disposed in the torpedo portion 15. The ring nut N2 surrounds the rear end portion of the inner cylindrical portion 68 of the rear housing 66 about the propeller axis Ap. As shown in FIG. 7, the ring nut N2 includes an outer peripheral portion provided with a male thread portion to be fitted to a female thread portion provided in the inner peripheral portion of the torpedo portion 15 and a concavo-convex inner peripheral portion provided with multiple convex portions protruding radially inward. A tool to rotate the ring nut N2 with respect to the lower case 13 is attached to the inner peripheral portion of the ring nut N2. As shown in FIG. 6, the ring nut N2 is disposed at the rear of the outer cylindrical portion 69 of the rear housing 66. The rear end portion of the rear housing 66 is pressed forward by the ring nut N2.

As shown in FIG. 6, the spacer 77 is disposed between the rear end of the interposed portion 47 of the front housing 42 and the front end of the inner cylindrical portion 68 of the rear housing 66. The rear end of the front housing 42 is supported from the rear on the front end of the rear housing 66 via the spacer 77. The rear housing 66 is pressed forward by the ring nut N2. The spacer 77 is pressed forward by the front end of the rear housing 66 and the rear end of the front housing 42 is pressed forward by the spacer 77. The front housing 42 is supported from the front on the bearing B4 supporting the rear gear 36, and the bearing B4 is supported from the front on the stepped portion 43 provided on the inner peripheral portion of the torpedo portion 15. The bearing B4, the front housing 42, the spacer 77, and the rear housing 66 are arranged between the ring nut N2 and the lower case 13 to be fixed in the front-rear direction.

As shown in FIG. 6, the spacer 77 is disposed around the planetary gear train 7. A portion of the planetary gear train 7 (ring gear 56) is disposed between the bearing B4 and the spacer 77 in the front-rear direction. The outside diameter of the spacer 77 is equal or substantially equal to that of the rear end of the front housing 42 and also to that of the front end of the rear housing 66. Meanwhile, the inside diameter of the spacer 77 is smaller than that of the rear end of the front housing 42 (rear end of the interposed portion 47). The spacer 77 is fitted into the front end portion of the rear housing 66. The spacer 77 is arranged between the front housing 42 and the rear housing 66 in the front-rear direction. The contact area between the rear housing 66 and the spacer 77 is greater than that between the front housing 42 and the spacer 77. Accordingly, a lower stress is generated at the portion where the rear housing 66 and the spacer 77 are in contact with each other than at the portion where the front housing 42 and the spacer 77 are in contact with each other.

The spacer 77 and the front housing 42 are preferably made of an iron-based material consisting primarily of iron such as stainless steel or carbon steel. The rear housing 66 is preferably made of an aluminum-based material consisting primarily of aluminum such as aluminum alloy. Accordingly, the strength of the rear housing 66 is lower than that of the spacer 77 and the front housing 42. As mentioned above, since the contact area between the rear housing 66 and the spacer 77 is greater than that between the front housing 42 and the spacer 77, a lower stress is generated at the portion where the rear housing 66 and the spacer 77 are in contact with each other than at the portion where the front housing 42 and the spacer 77 are in contact with each other. The rear housing 66 is thus applied with a dispersed stress not to be deformed, though having a relatively low strength.

As shown in FIG. 6, the spacer 77 is engaged with the front housing 42. Specifically, the interposed portion 47 of the front housing 42 includes multiple pins provided on the rear end portion thereof. The spacer 77 includes multiple grooves provided in the front end portion thereof. The multiple pins are disposed in a circumferentially spaced manner and protrude rearward. The multiple grooves are disposed in a circumferentially spaced manner and recessed rearward. The multiple pins are disposed in the respective multiple grooves, so that the interposed portion 47 and the spacer 77 are engaged with each other. This restricts the relative rotation of the interposed portion 47 and the spacer 77 in the circumferential direction.

The front end portion of the torpedo portion 15 is filled with oil to lubricate the movement of the forward-reverse traveling switching mechanism 6. That is, the forward-reverse traveling switching mechanism 6 is disposed in an oil-filled space. As shown in FIG. 6, the space in which the forward-reverse traveling switching mechanism 6 is housed is in communication with the interior space of the front housing 42 via an oil groove 78 extending rearward from the rear of the pinion 34 along the inner peripheral portion of the torpedo portion 15 and an oil hole 79 penetrating the upper end portion of the interposed portion 47 in the radial direction. The oil hole 79 is disposed below and opposed to the oil groove 78. As mentioned above, the engagement between the interposed portion 47 and the spacer 77 restricts the rotation of the front housing 42 in the circumferential direction with respect to the lower case 13. This can prevent a change in the flow of oil due to a change in the positional relationship between the oil groove 78 and the oil hole 79.

Figure 8:
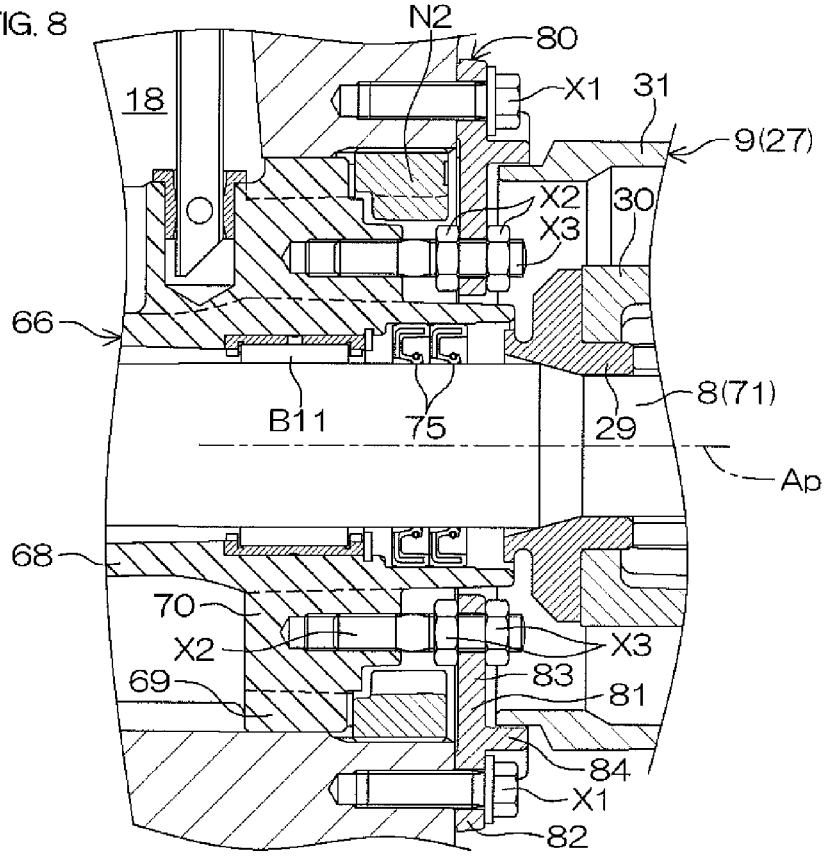
FIG. 8 is a cross-sectional view showing a fixing member, outer peripheral fastening members, and inner peripheral fastening members attached to the lower case and the rear housing.
Figure 9:
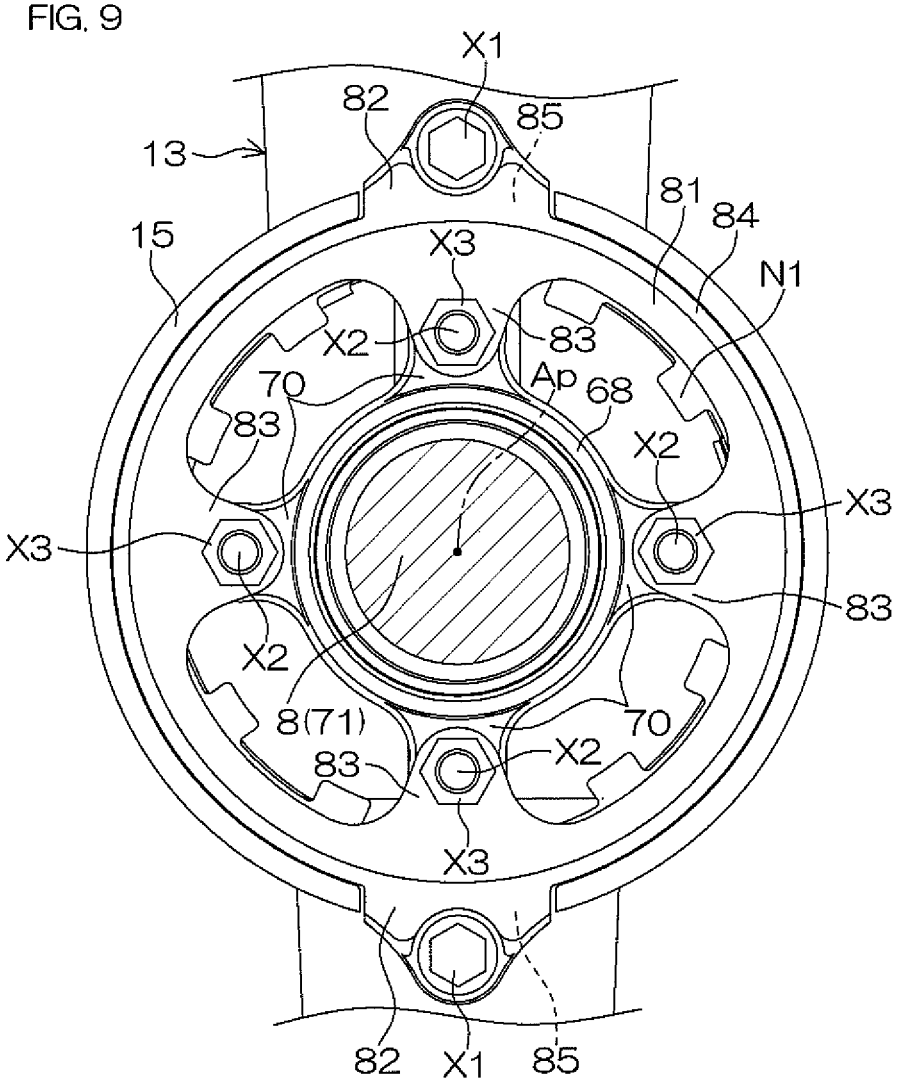
FIG. 9 shows, in a rear view, the fixing member, the outer peripheral fastening members, and the inner peripheral fastening members attached to the lower case and the rear housing.

FIG. 8 is a cross-sectional view showing a fixing member 80, outer peripheral fastening members X1, and inner peripheral fastening members X2, X3 attached to the lower case 13 and the rear housing 66. FIG. 9 shows, in a rear view, the fixing member 80, the outer peripheral fastening members X1, and the inner peripheral fastening members X2, X3 attached to the lower case 13 and the rear housing 66.

As shown in FIG. 8, the outboard motor 3 includes an annular fixing member 80 surrounding the propeller shaft 8 about the propeller axis Ap, multiple outer peripheral fastening members X1 fixing the outer peripheral portion of the fixing member 80 to the lower case 13, and multiple inner peripheral fastening members X2, X3 fixing the inner peripheral portion of the fixing member 80 to the lower housing 66. The outer peripheral fastening members X1 may be a hexagonal bolt including a hexagonal columnar head portion and an axial portion integrated with the head portion, for example. The outer peripheral fastening members may also include a stud bolt provided with male threads at the ends thereof and one or more adjustable nuts fitted to the stud bolt, for example. The same applies to the inner peripheral fastening members X2, X3. FIGS. 8 and 9 show the case where the outer peripheral fastening members are hexagonal bolts X1 and the inner peripheral fastening members include a stud bolt X2 and two adjustable nuts X3.

As shown in FIG. 8, the fixing member 80 is attached to the rear end portion of the torpedo portion 15. The fixing member 80 surrounds the inner cylindrical portion 68 of the rear housing 66 about the propeller axis Ap. The inner peripheral surface of the fixing member 80 constitutes a portion of the rearward guide portion 19 to guide exhaust gas rearward. The fixing member 80 is disposed between the lower case 13 and the propeller 9. The fixing member 80 is also disposed at a position more rearward than the outer cylindrical portion 69 and the rib portions 70 of the rear housing 66. The ring nut N2 is disposed between the outer cylindrical portion 69 and the fixing member 80. The fixing member 80 is bolted from the rear to the lower case 13 and the rear housing 66. The fixing member 80 is thus fixed circumferentially with respect to the lower case 13 and the rear housing 66.

As shown in FIG. 9, the fixing member 80 includes an annular portion 81 surrounding the rear end portion of the inner cylindrical portion 68 about the propeller axis Ap, one or more case fixing portions 82 protruding radially outward from the annular portion 81, and one or more housing fixing portions 83 protruding radially inward from the annular portion 81. As shown in FIG. 8, the fixing member 80 further includes a cylindrical portion 84 coaxial with the annular portion 81 and extending rearward from the annular portion 81.

As shown in FIG. 8, the annular portion 81 is disposed at the rear of the ring nut N2. The cylindrical portion 84 extends rearward from the rear end surface of the annular portion 81. The cylindrical portion 84 has an inside diameter greater than that of the annular portion 81. The front end portion of the outer cylinder 31 of the propeller 9 is fitted into the cylindrical portion 84 in a freely movable manner. The front end portion of the outer cylinder 31 is disposed at the rear of the annular portion 81. The annular portion 81 is disposed between the ring nut N2 and the outer cylinder 31 in the front-rear direction. As shown in FIG. 9, the annular portion 81 is disposed in the rear end portion of the torpedo portion 15. Accordingly, the outside diameter of the annular portion 81 is smaller than the inside diameter of the rear end portion of the torpedo portion 15.

As shown in FIG. 9, two case fixing portions 82 extend radially outward from the outer peripheral portion of the annular portion 81. The two case fixing portions 82 are disposed in an equally spaced manner in the circumferential direction. The two case fixing portions 82 are disposed, respectively, in multiple notches 85 provided in the rear end portion of the torpedo portion 15. The outer end portion of each case fixing portion 82 is disposed on the outside of the rear end portion of the torpedo portion 15. Meanwhile, four housing fixing portions 83 extend radially inward from the inner peripheral portion of the annular portion 81. The four housing fixing portions 83 are disposed in an equally spaced manner in the circumferential direction. The inner end portion of each housing fixing portion 83 is disposed on the outside of the rear end portion of the inner cylindrical portion 68.

As shown in FIG. 8, the multiple hexagonal bolts X1 are attached, respectively, to the two case fixing portions 82. The axial portion of each hexagonal bolt X1 is inserted in a through-hole penetrating the corresponding case fixing portion 82 in the axial direction. The front end portion of the axial portion is fitted to a female thread hole extending forward from the rear end surface of the lower case 13. The head portion of each hexagonal bolt X1 is disposed at the rear of the corresponding case fixing portion 82. Each case fixing portion 82 is fastened axially by the head portion of the corresponding hexagonal bolt X1 and the lower case 13. The two case fixing portions 82 are thus bolted to the lower case 13 and thus fixed circumferentially and axially with respect to the lower case 13.

As shown in FIG. 9, four stud bolts X2 are attached, respectively, to the four housing fixing portions 83. As shown in FIG. 8, each stud bolt X2 is inserted in a through-hole penetrating the corresponding housing fixing portion 83 in the axial direction. The front end portion of each stud bolt X2 is fitted to a female thread hole extending forward from the rear end surface of the rib portion 70 of the rear housing 66. Two adjustable nuts X3 attached to the common stud bolt X2 are disposed at the rear of the common rib portion 70. The two adjustable nuts X3 are disposed, respectively, in the front and the rear of the corresponding housing fixing portion 83. The two adjustable nuts X3 are attached to the rear end portion of the stud bolt X2, and the housing fixing portion 83 is fastened axially by the two adjustable nuts X3. The four housing fixing portions 83 are thus bolted to the rear housing 66 and fixed circumferentially and axially with respect to the rear housing 66.

The pair of adjustable nuts X3 is movable axially with respect to the corresponding stud bolt X2. The position of each housing fixing portion 83 with respect to the corresponding stud bolt X2 is adjusted by the position of the adjustable nuts X3 with respect to the stud bolt X2. The housing fixing portions 83 are bolted to the rear housing 66. As shown in FIG. 6, the rear housing 66 is supported on the stepped portion 43 of the lower case 13 via multiple members (ring washer 44, bearing B4, front housing 42, and spacer 77) and positioned axially by the stepped portion 43. Since the multiple members are interposed between the rear housing 66 and the stepped portion 43, the position of the rear housing 66 with respect to the lower case 13 varies depending on accumulated dimensional errors of these members. It is therefore possible to reduce dimensional errors of the multiple members by adjusting the position of each housing fixing portion 83 with respect to the corresponding stud bolt X2 using the two adjustable nuts X3. This allows the housing fixing portions 83 to be fastened reliably in the axial direction and to have no backlash.

The rear housing 66 is thus fixed circumferentially to the lower case 13 using the fixing member 80. The sun gear 55 of the planetary gear train 7 is supported on the rear housing 66 so as not to be rotatable circumferentially with respect to the rear housing 66. The rotation of the drive shaft 5 is reduced by the forward-reverse traveling switching mechanism 6 defining and serving as a first reducer mechanism, and the rotation of the forward-reverse traveling switching mechanism 6 is reduced by the planetary gear train 7 defining and serving as a second reducer mechanism. Accordingly, when the rotation of the drive shaft 5 is transmitted through the forward-reverse traveling switching mechanism 6 and the planetary gear train 7 to the propeller shaft 8, a high torque is applied to the sun gear 55. Fixing the rear housing 66 firmly to the lower case 13 can reliably prevent the sun gear 55 from rotating. This allows the rotation of the drive shaft 5 to be transmitted reliably to the propeller shaft 8.

As described heretofore, in the present preferred embodiment of the present invention, the rotation of the engine 4 is transmitted to the propeller 9 attached to the propeller shaft 8 through the drive shaft 5, the forward-reverse traveling switching mechanism 6, the planetary gear train 7, and the propeller shaft 8. The rear gear 36, which is constituted as a bevel gear, is supported on the bearing B4 in a manner rotatable about the propeller axis Ap. The front housing 42 supports the rear gear 36 via the bearing B4 in a manner rotatable about the propeller axis Ap. Meanwhile, the rear housing 66 supports the propeller shaft 8 at a position more rearward than the rear gear 36 in a manner rotatable about the propeller axis Ap. Since separate housings are thus provided to support the rear gear 36 and the propeller shaft 8, respectively, as the front housing 42 and the rear housing 66, the inside diameter of the portion housing therein a transmitting mechanism such as the planetary gear train 7 cannot be restricted by the bearing B4. It is therefore possible to have a larger space that houses therein a transmitting mechanism and other components without changing the size of the lower case 13 to be disposed in water.

Further, in the present preferred embodiment of the present invention, the sun gear 55, a fixed element of the planetary gear train 7, is supported on the front housing 42 to prevent rotation with respect to the front housing 42. Accordingly, when the rotation of the engine 4 is transmitted to the propeller 9, a high torque is applied from the sun gear 55 to the front housing 42. The fixing member 80 is bolted to both the front housing 42 and the lower case 13. The fixing member 80 is thus fixed firmly to both the front housing 42 and the lower case 13 about the propeller axis Ap. Since the front housing 42 is accordingly fixed firmly to the lower case 13 about the propeller axis Ap, the front housing 42 is much less likely to have backlash. The sun gear 55, a fixed element of the planetary gear train 7, can thus be fixed firmly and securely.

Other Preferred Embodiments

Although a preferred embodiment of the present invention has been described as above, the present invention is not limited to the contents of the above-described preferred embodiment, and can be variously modified within the scope of the appended claims.

For example, the preferred embodiment above describes the case where the sun gear, a fixed element of the planetary gear train, is supported on the rear housing in a manner not rotatable with respect to the housing. However, another element other than the sun gear may be supported on the rear housing. That is, the planetary gear train may include another fixed element other than the sun gear.

In addition, the preferred embodiment above describes the case where the front housing includes the gear support portion, the locking portion, and the interposed portion. However, the structure of the front housing is not limited thereto. Similarly, the structure of the rear housing is not limited to the structure described in the preferred embodiment above. For example, the interposed portion may not be a portion of the front housing but may be a portion of the rear housing. That is, the interposed portion may not be integrated with the front housing but may be integrated with the rear housing. Alternatively, no interposed portion may be provided, that is, the rear end of the front housing and the front end of the rear housing may be opposed in the front-rear direction to each other with a space therebetween.

Further, the preferred embodiment above describes the case where the rear end of the front housing is supported on the front end of the rear housing via the spacer. However, the rear end of the front housing may be supported directly on the front end of the rear housing. That is, no spacer may be provided. Furthermore, the front housing, the spacer, and the rear housing may be an integrated housing that defines a single unitary monolithic structure.

Moreover, the preferred embodiment above describes the case where the fixing member includes two case fixing portions and four housing fixing portions. However, the number of case fixing portions may be one or three or more. Similarly, the number of housing fixing portions may be three or less or five or more. Further, the number of case fixing portions may be equal to or greater than the number of housing fixing portions.

The present application corresponds to Japanese Patent Application No. 2012-167568 filed on Jul. 27, 2012 in the Japan Patent Office, the entire disclosure of which is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A vessel propulsion apparatus comprising:

a prime mover arranged to generate power to rotate a propeller about a propeller axis;

a propeller shaft extending along the propeller axis, the propeller shaft arranged to transmit a rotation of the prime mover toward the propeller;

a planetary gear train including a sun gear, a ring gear, a planetary gear, and a carrier and disposed on the propeller axis, the planetary gear train being arranged to reduce the rotation transmitted to the propeller shaft;

a case in which the propeller shaft and the planetary gear train are housed;

a housing housed in the case and surrounding the propeller shaft about the propeller axis inside the case and supporting the planetary gear train in state in which one of the sun gear, the ring gear, the planetary gear, and the carrier is not rotatable with respect to the housing; and a fixing member surrounding the propeller shaft about the propeller axis and fixed to both the case and the housing to prevent circumferential displacement of the housing with respect to the case.

2. The vessel propulsion apparatus according to claim 1, wherein the housing is cylindrical and supports the sun gear in a state in which the sun gear is not rotatable with respect to the housing.

3. The vessel propulsion apparatus according to claim 1, wherein the prime mover includes an internal combustion engine; and the fixing member includes an inner peripheral surface defining a portion of a discharge passage to discharge exhaust gas from the internal combustion engine.

4. The vessel propulsion apparatus according to claim 1, wherein the fixing member includes an annular portion surrounding the propeller shaft about the propeller axis and at least one case fixing portion protruding radially outward from the annular portion and fixed to the case.

5. The vessel propulsion apparatus according to claim 1, wherein the fixing member includes an annular portion surrounding the propeller shaft about the propeller axis and at least one housing fixing portion protruding radially inward from the annular portion and fixed to the housing.

6. The vessel propulsion apparatus according to claim 1, wherein the fixing member is fixed to both the case and the housing from a rear of the case and the housing.

7. The vessel propulsion apparatus according to claim 1, wherein the housing includes an inner cylindrical portion surrounding the propeller shaft about the propeller axis, an outer cylindrical portion surrounding the inner cylindrical portion and spaced from the inner cylindrical portion in a radial direction of the housing, and a rib portion connecting the inner cylindrical portion and the outer cylindrical portion; and the fixing member is fixed to the rib portion.

* * * * *